US006676873B2

(12) United States Patent
Anderson

(10) Patent No.: US 6,676,873 B2
(45) Date of Patent: Jan. 13, 2004

(54) FLEXIBLE, ONE PIECE ROAD SYSTEM FOR USE IN SCALE MODELING

(76) Inventor: Theodore Philip Anderson, 15 Loyalist Dr., Uxbridge, MA (US) 01569

( * ) Notice: Subject to any disclaimer, the term of this patent is extended or adjusted under 35 U.S.C. 154(b) by 390 days.

(21) Appl. No.: 09/850,515

(22) Filed: May 7, 2001

(65) Prior Publication Data

US 2002/0162206 A1 Nov. 7, 2002

(51) Int. Cl.[7] ..... B29C 33/38
(52) U.S. Cl. ..... 264/220; 264/219
(58) Field of Search ..... 264/219, 220

(56) References Cited

U.S. PATENT DOCUMENTS 2,866,418 A * 12/1958 Petrick, Sr. ..... 104/305
3,729,133 A * 4/1973 Covert ..... 238/10 E
3,844,052 A * 10/1974 Fraanje et al. ..... 434/433
5,299,735 A * 4/1994 Thomas ..... 238/10 B

* cited by examiner

*Primary Examiner*—Allan R. Kuhns

(57) ABSTRACT

The present invention revolutionizes a scale modelers ability to quickly and easily create realistic scale roads or paved surfaces by allowing the said user to create said road or road system in any size, shape or configuration. This work is to be performed on a work bench thus saving much back and muscle ache(s) from the necessity to lean over a layout or scale model scene to create a road or road system in place. The present invention will remain flexible in it's completed form allowing for placement onto varying ground elevations and hill grades.

1 Claim, 7 Drawing Sheets

FLEXIBLE, ONE PIECE ROAD SYSTEM FOR USE IN SCALE MODELING

BRIEF DESCRIPTION

A system for providing a flexible, one piece road or roads or any paved surface in any pattern, length or size that exhibits a real-life appearance for use in model railroad layouts or any small scale model.

BACKGROUND OF THE INVENTION

For many years, hobby enthusiasts have enjoyed the operation of model railroad trains and have labored to create life-like settings in which to operate these model trains. Such enthusiasts have been known to go to great lengths to simulate the realism of an actual railroad, including scale models of buildings, cars and people, which are intricately prepared, painted and positioned to create the life-like setting.

One difficulty often encountered in creating such a life-like scene, however, is the necessity to build roads and other paved surfaces in place in the actual scale model scene. Hobbyists and model makers have created life-like roads and other paved surfaces before but only two methods are generally commercially available. One scale model road design requires painstaking effort in creating the road or road system. This involves the application of plaster to the model scene. It may also involve the tinting, staining or coloring of the plaster road. The second method usually results in a less than life-like appearance owing to it's general physical appearance. This second method involves the use of pre-cut imprinted semi-rigid sections of road or pre-colored, re-cut strips of road of foam rubber that represent a road.

Those who create a scale model scene do not always have the time to create realistic roads and sometimes rely on preformed versions of roads that are commercially available that are sometimes set and rigid in their shape (Faller, Pola) or are made of flexible foam rubber and the like (available from Faller or Walther's) that may be laid down in strips in place on the scale model scene whether the scene is completed or not.

With the aforementioned use of pre-cut roads, a contiguous road design with no gaps or seams between sections is not possible unless much effort is employed to blend these gaps and seams and the modeler/hobbyist is extremely restricted and confined in his or her road design by the pre-cut shapes that are commercially available to him or her.

The previously mentioned first method used by hobbyists for constructing roads is with the use of plaster or modified plaster (Woodland Scenics). Plaster may be formed, shaped, sculpted and smoothed in place on the scale model scene whether the scene is completed or not.

However, plaster is relatively permanent and inflexible. Cracking from seasonal expansion and contraction of the layout base and other scale model materials may occur. The hobbyist cannot move the road once it is in place. It is also rather difficult and messy to apply plaster in a uniform manner especially in an already completed scene where many scale buildings, people, trees and other miniatures may be damaged, sometimes permanently, by the mess created by working in those kinds of tight quarters.

In the preferred embodiment, the road material (dried paste) will flex to adjust and conform to any movement within the scale model scene or layout causes by seasonal expansion and contraction or other causes.

Aching back muscles is another problem associated with the employment of plaster for roads in a scale model. The necessity to lean over the layout or model scene for long periods of time can cause some pain to the modeler.

In the present invention, the need to lean over a layout or scale model scene is minimized by allowing the modeler to work comfortably over a work bench or other flat, level surface and then physically transfer the completed road system to the layout or model scene.

The modeler must also stain, tint, paint or otherwise color the plaster road to achieve a life-like appearance, requiring many applications of colorant and many hours of labor.

Plaster roads invariably need sanding that creates dust that may damage, sometimes permanently, the scene surrounding the newly installed road. The present invention requires no sanding or any other cosmetic work done to it to exhibit a realistic look.

The material described in this invention will remain flexible after it is dry. This allows the modeler to install the completed road in any scene. Said road will conform in shape to any and all elevation and/or grade changes.

Because of the invention's ability to be cut to any shape or size, the modeler now has the ability to easily customize the shape and scope of the road system exactly to his or her preference or needs.

For the purpose of description of this invention, a road system is hereby defined as any road having one or more, but not limited to, adjoining roadways, diverging routes, drive ways, parking lots, side walks and any paved surface encountered by said one piece road.

A traffic line painting kit accompanies this flexible, one piece road system, but will not be discussed in this application as it employs a common painting technique to create lines with very well defined edges.

SUMMARY OF INVENTION

The present invention relates to a system for providing a one piece road or road system in any pattern, length or size that will exhibit a cosmetic capacity to take on the life-like appearance of a real life road for use in model railroad layouts or any small scale model and to build and construct said one piece road on a work bench or any other suitable flat, level surface.

The invention is further directed to a method for producing the road material in it's wet paste form.

The present invention creates a revolutionary new way of constructing roads for scale models.

DETAILED DESCRIPTION OF THE INVENTION

The present invention relates to a system for providing a one piece road or road system (system is defined here as any branch or diverging route, road or street, driveway, parking lot, bike path, sidewalk, etc.) in any pattern, length or size that will exhibit a cosmetic capacity to take on the life-like appearance of a real life road for use in model railroad layouts or any small scale model and to build and construct said one piece road on a work bench or other suitable flat, level surface comprising the steps of:

(a.) Cutting and shaping pieces of any type of paper suitable for this work with household scissors to fit the intended location of the scale road or paved surface (road system) on a scale model or layout. The paper will serve as a template (FIG. 1,11) for creating the finished scale paved surface (road system) or road.

Figure 1:
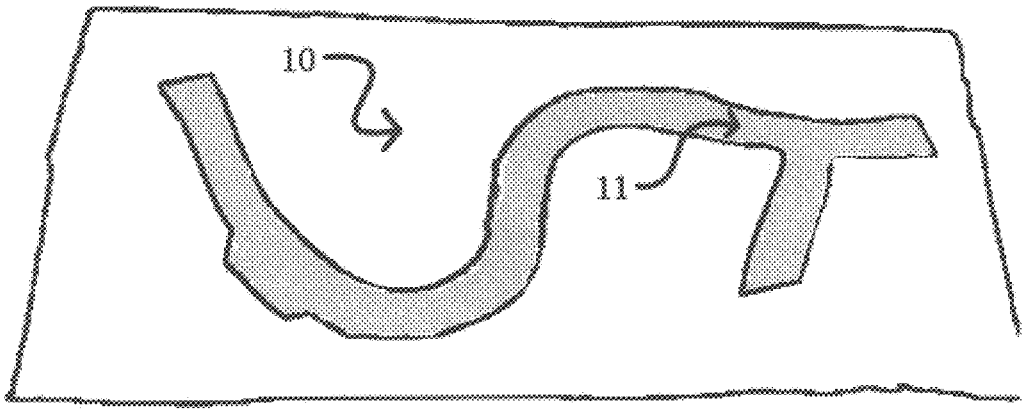
FIG. 1 depicts a paper template as it lays on a sheet of plastic.

(b.) Cutting out, using household scissors, a suitably sized piece of plastic sheet sized to encompass the dimensions of the paper template referred to in claim 1a (FIG. 1,10).

Figure 2:
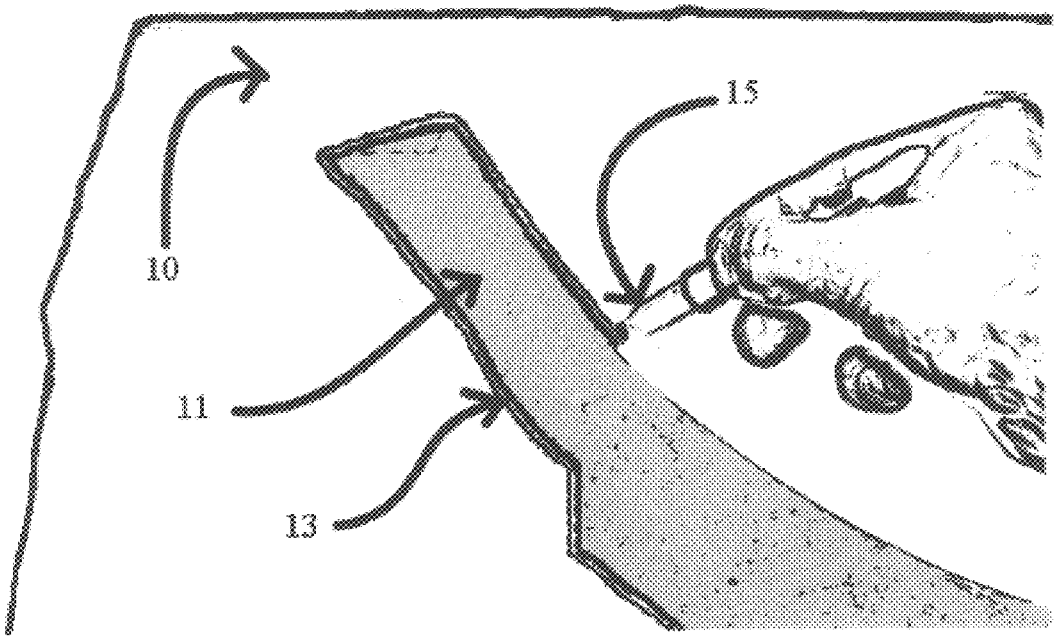
FIG. 2 depicts the modeler tracing an outline with an indelible ink marker around the edges of the paper template onto a sheet of plastic.

(c.) Drawing a line (FIG. 2,13) with indelible marker (FIG. 2,15) around the paper template (FIG. 2,11), exactly to the template's edges (FIG. 2,13), onto a plastic sheet (FIG.2, 10).

Figure 3:
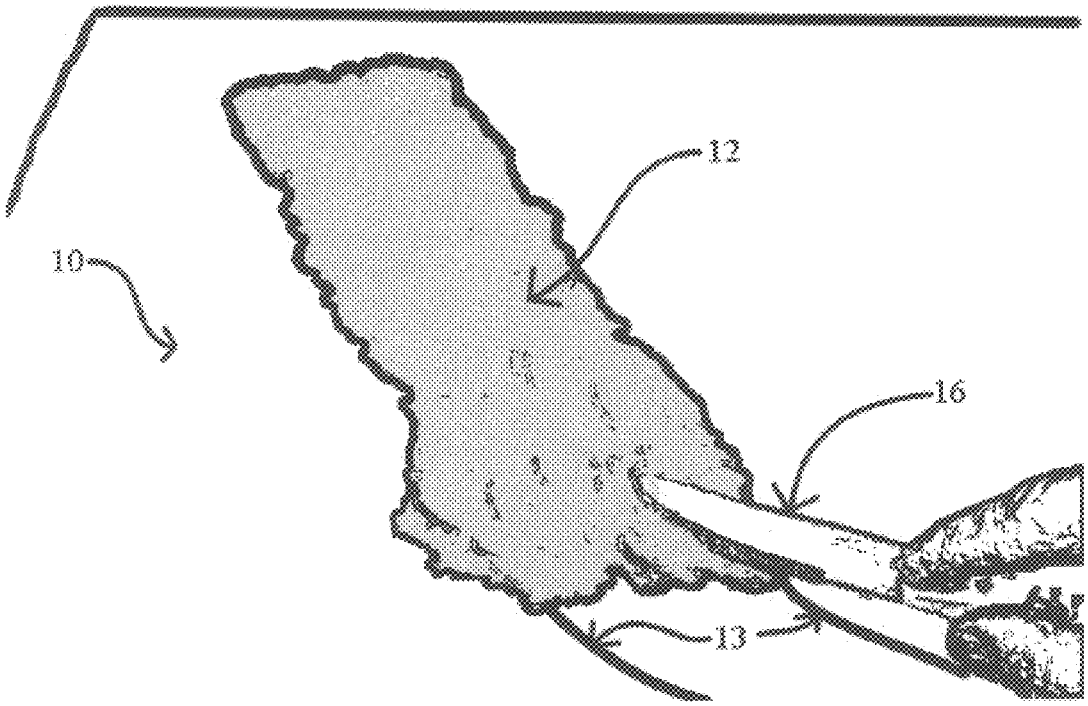
FIG. 3 depicts the modeler spreading wet paste with a knife to cover all areas encompassed by the outline.

(d.) Spreading out a wet paste (FIG. 2,12) on plastic sheet (FIG., 3,10.) to completely cover the area encompassed by the template outline (3,13) employing a butter knife (FIG. 3,16) to perform this action.

Figure 4:
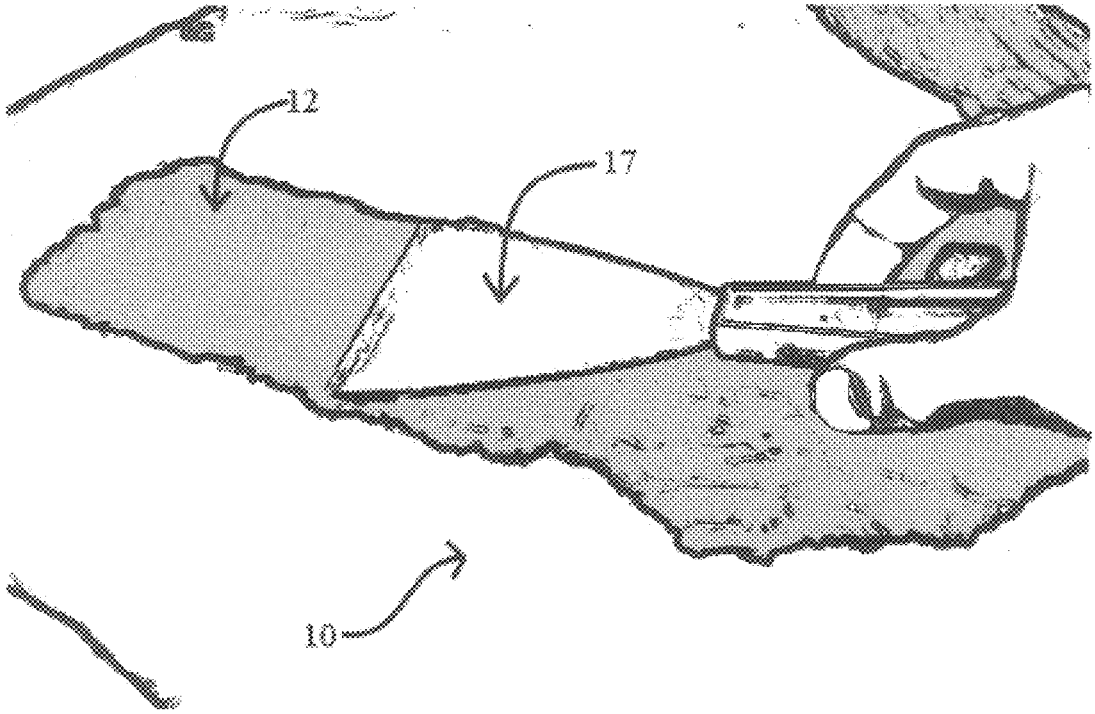
FIG. 4 depicts the modeler smoothing out and leveling the paste using a common wall scraper.

(e.) Leveling and smoothing the paste employing the use of a commercially available wall scraper (FIG. 4,17) to accomplish said smoothing and leveling.

Figure 5:
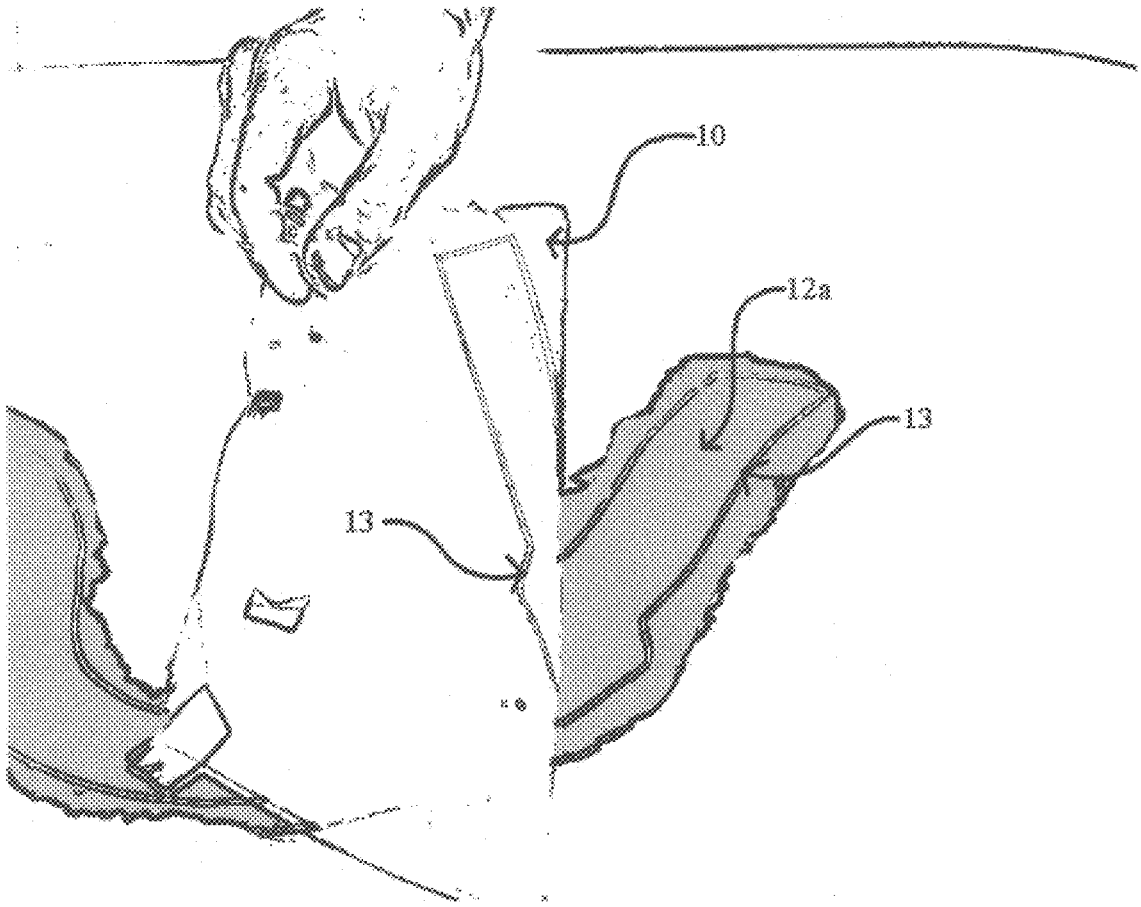
FIG. 5 depicts the modeler peeling away the plastic sheet as the lines drawn on the plastic sheet transfer to the dried paste sheet.

(f.) Removal of plastic sheet (FIG. 5,10) from dried paste sheet (FIG. 5,12*a*) The paste will peal off plastic sheet easily.

(g.) Transfer of lines from the plastic sheet (FIG. 5,10) to dried paste (FIG. 5,12*a*) by simple absorption inherent to the mechanics of the paste as it dries.

Figure 6:
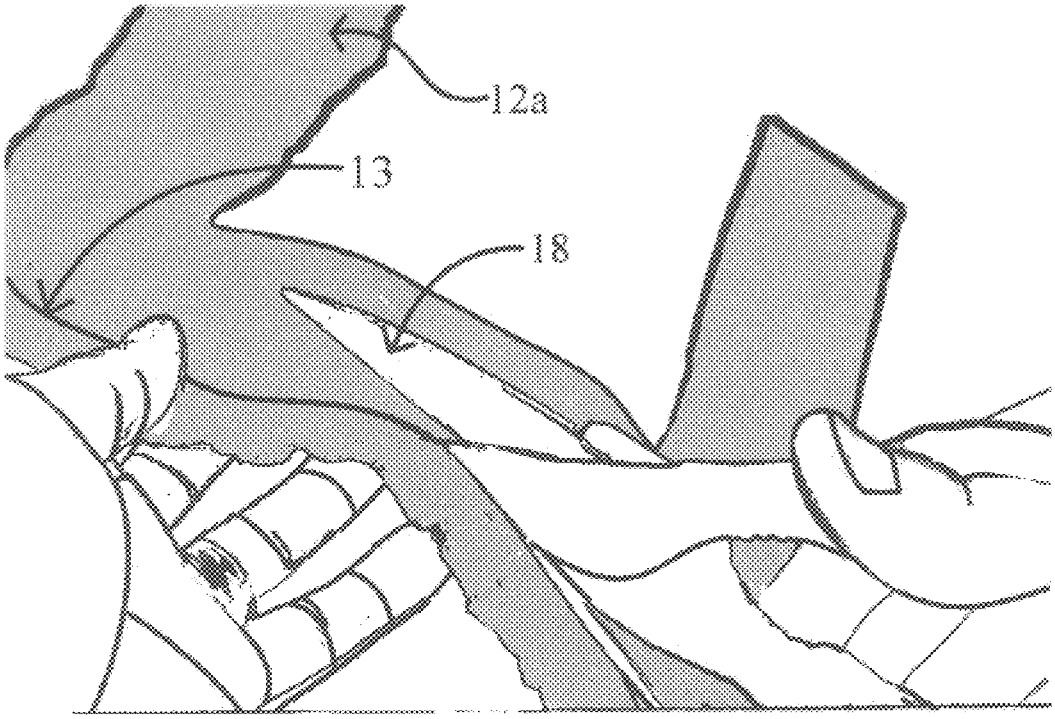
FIG. 6 depicts the modeler using scissors to cut the dried paste sheet along lines located on the back of the paste sheet.

(h.) Cutting dried paste (FIG. 6,12*a*) with scissors (FIG. 6,18) following the lines (FIG. 6,13) imprinted on back of dried paste sheet.

Figure 7:
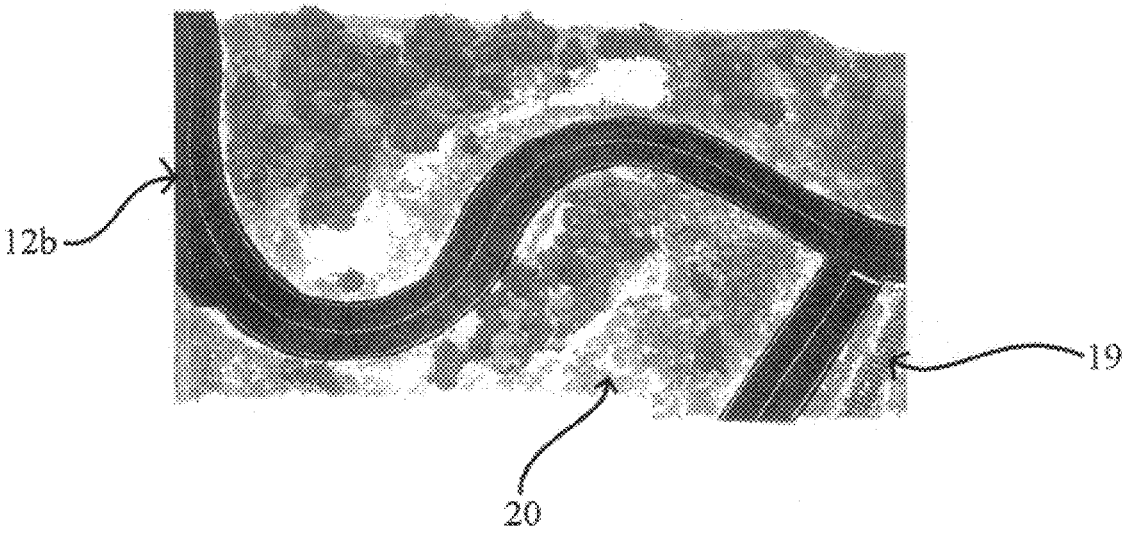
FIG. 7 depicts the newly created road as it has been applied to a scale model scene.

(I.) Installing completed road or road system (FIG. 7,12*b*) onto a finished or unfinished model scene (FIG. 7,20) or layout.

The present invention is also directed to a method for producing the wet paste needed for the creation of a flexible, one piece road consisting of the steps:

(a) Combining and mixing equal amounts of water, polymeric resin and talc in a suitable mixer (set aside and equal amount of clay filler (Wilklay-Prime Materials Assoc.)for later incorporation to the mixture.

(b) Adding sufficient amounts of a plasticizer so that it will remain flexible after it dries.

(c) Adding said set-aside clay filler to mixture referred to in (b.) of this section and mixing until smooth.

What I claim as my invention is:

1. A method for creating realistic looking scale-sized roads including, but not limited to, rural roads, urban roads, highways, bike paths, sidewalks, driveways, parking lots or any other paved surface in any size, shape or configuration consisting of the steps of:

(a) creating a template utilizing a piece or pieces of paper and scissors to create an exact replica of an intended road system on a scale model or layout;

(b) tracing a line around the paper template exactly to the template's edges onto a flexible plastic sheet using an indelible ink marker to form an outline on the plastic sheet;

c) spreading a wet paste to cover the area encompassed by the outline;

(d) leveling and smoothing the wet paste and allowing the wet paste to dry;

(e) allowing at least part of the ink from the line drawn on the plastic sheet to be transferred to the drying paste;

(f) cutting along transferred lines on the bottom of the dried paste, thereby producing a road or road system that matches the previously constructed paper template; and (g) orienting the road or road system so that it lays face up in position(s) indicated by the shape and placement of the paper template on an intended scale scene or layout.

* * * * *